US005080223A

United States Patent [19]

Mitsuyama

[11] Patent Number: 5,080,223

[45] Date of Patent: Jan. 14, 1992

[54] CARD CASE HAVING A FINGER ACCESS HOLE

[76] Inventor: Masuhiro Mitsuyama, 1071, Kinugasa, Wake-cho, Wake-gun, Okayama, Wake, Japan

[21] Appl. No.: 530,396

[22] Filed: May 30, 1990

[30] Foreign Application Priority Data

Oct. 26, 1989 [JP] Japan ..... 1-126131
Dec. 27, 1989 [JP] Japan ..... 1-151472

[51] Int. Cl.[5] ..... A45C 11/18

[52] U.S. Cl. ..... 206/39.5; 150/147; 206/37; 206/38; 206/449; 383/106

[58] Field of Search ..... 206/37, 38, 39, 39.5, 206/39.6, 449; 150/147-149; 383/106, 39, 40; 229/71; 40/661

[56] References Cited

U.S. PATENT DOCUMENTS

| | | | |
|---|---|---|---|
| 404,584 | 6/1889 | Williamson | 206/39.5 |
| 501,431 | 7/1893 | Lambert | 150/149 |
| 912,110 | 2/1909 | Gill | 206/39.5 |
| 1,051,198 | 1/1913 | Collins | 206/39.6 |
| 1,670,343 | 5/1928 | Clemens | 206/39.5 |
| 1,857,488 | 5/1932 | Weeks | 206/39.5 X |
| 1,908,115 | 5/1933 | Chadwick | 206/39.5 X |
| 1,952,732 | 3/1934 | Simon | 150/147 X |
| 2,741,572 | 4/1956 | Lennartz | 150/147 X |
| 2,763,311 | 9/1956 | Sparrow | 150/147 |
| 2,920,671 | 1/1960 | Siris et al. | 383/106 X |
| 3,086,572 | 4/1963 | Lubin . | |
| 3,154,125 | 10/1964 | Harvey . | |
| 3,360,027 | 12/1967 | Price . | |
| 3,435,868 | 4/1969 | Stermer . | |
| 3,530,961 | 9/1970 | Weissenbach . | |
| 3,659,640 | 5/1972 | Fenster et al. | 150/147 |
| 3,899,127 | 8/1975 | Melander . | |
| 3,958,690 | 5/1976 | Gee, Sr. | 206/38 X |
| 4,388,958 | 6/1983 | Dworkin . | |
| 4,477,013 | 10/1984 | Herrin . | |
| 4,895,198 | 1/1990 | Samuelson . | |

FOREIGN PATENT DOCUMENTS

| | | | |
|---|---|---|---|
| 244524 | 1/1966 | Austria | 150/147 |
| 1021 | 1/1904 | United Kingdom | 150/147 |
| 526108 | 9/1940 | United Kingdom | 150/147 |

OTHER PUBLICATIONS

IBM Technical Disclosure Bulletin, vol. 18, No. 5, Oct. 1975.

*Primary Examiner*—Bryon P. Gehman
*Attorney, Agent, or Firm*—Wenderoth, Lind & Ponack

[57] ABSTRACT

Disclosed is a card case, made of two rectangular sheets of plastic or leather, produced by fusing or seaming three edges thereof together and leaving one edge thereof unfused. One or both of the rectangular sheets are provided with an elongated opening the width of which is at least sufficient to receive a finger tip so as to allow a card to be pushed through the open side. The card case is constructed such that it can be used conveniently for cash dispenser cards, telephone cards, name cards, season tickets and the like because bearers can remove the cards quickly from the case by simply putting their finger tip on the card through the opening and pushing the card out.

10 Claims, 4 Drawing Sheets

FIG.13 - PRIOR ART

FIG.14 - PRIOR ART

CARD CASE HAVING A FINGER ACCESS HOLE

BACKGROUND OF THE INVENTION

2. Field of the invention

This invention relates to a card case for cash dispenser (CD) cards, telephone cards, name cards, season tickets and the like. More specifically it relates to a card case from which a card can be removed very easily.

2. Prior art

Hitherto a card case has been used for holding CD cards or telephone cards, for example. FIGS. 13 and 14 show such a conventional card case, for which generally thin leather or plastic sheeting is used.

In order to make the card case 3, at first two sheets 2, 2, cut to a size a little larger than that of a card 1, are superposed one on top of another and then their three sides are fused together by heating with their one side left open (at 4) so that the card 1 can be put in or taken out of the card case 3 through the opening 4. Also, an indent 5 is provided to the open side in order that the card 1 in the card case 3 may be held between fingers when removed therefrom. Problems to be solved by the invention In such conventional card case, however, the indent 5 is generally so shallow that it is difficult to hold one side of the card appearing out of the card case 3 between fingers. This is especially true during cold winters due to fingers becoming numbed by the cold.

Under the circumstances, the object of the invention is to solve the above mentioned problem and to provide a card case which allows bearers to remove a card therefrom without any difficulty even when their fingers are numbed due to cold.

SUMMARY OF THE INVENTION

For the above mentioned object, the inventor has invented a card case comprising two sheets, each of which has four edges. The two sheets are fused together along three of their four edges, the fourth edge of the respective sheets remaining separable so that a card can be put in or removed through an opening formed thereby. The card case includes an elongated opening, the width of which is at least sufficient to receive a finger tip, provided between the opening formed by the separable fourth edges and a closed end formed opposite the opening by fused edges of the sheets.

The card case of the invention is formed in such a way that those who bear it can remove a card therefrom by pushing the card toward the opening with a finger tip and withdrawing the card by holding it between fingers.

BRIEF DESCRIPTION OF THE DRAWINGS

FIGS. 13 and 14 are perspective views of a conventional card case.

DESCRIPTION OF THE PREFERRED EMBODIMENTS

Figure 1:
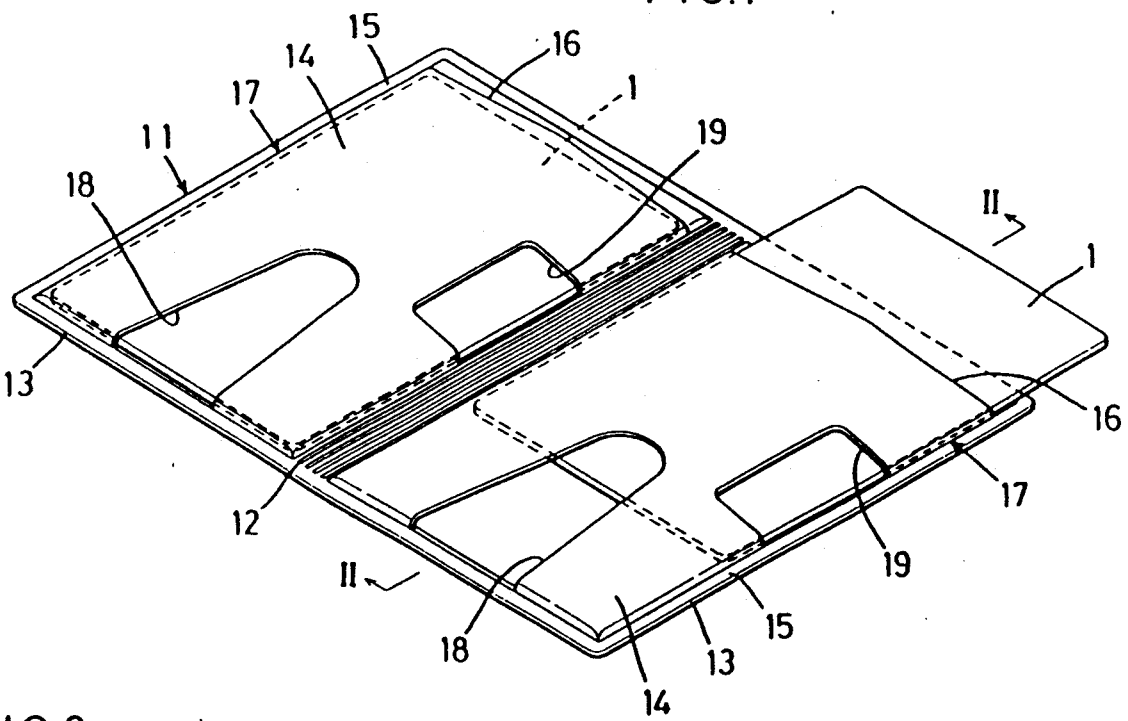
FIG. 1 is a perspective view of a card case according to a first embodiment of this invention.
Figure 2:
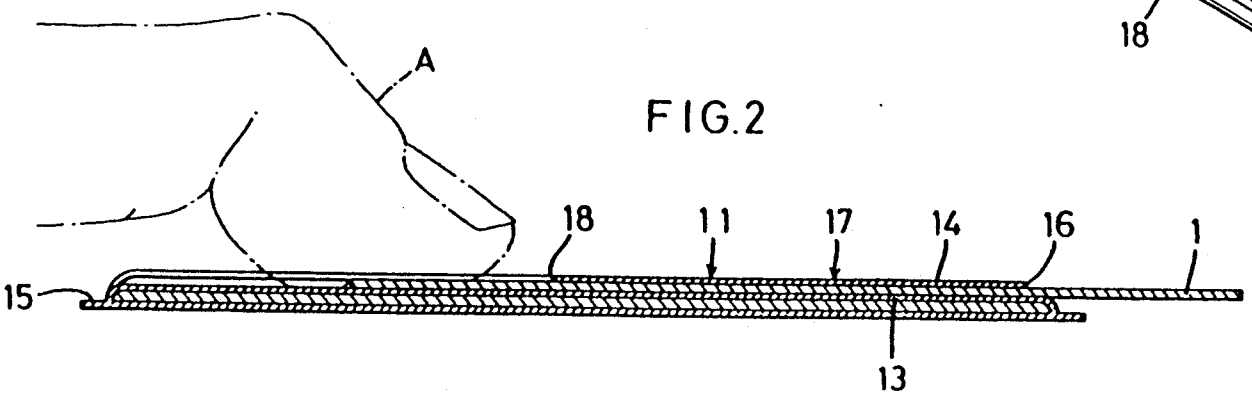
FIG. 2 is a cross-sectional view of the card case taken along line II—II of FIG. 1.

FIGS. 1 and 2 show a bi-fold card case 11 according to a first embodiment of this invention. Two rectangular base sheets 13, 13 of equal size and having lengths slightly greater than the length of a card 1 are joined together by a pliable portion 12. Another two rectangular cover sheets 14, 14 of equal size and having lengths slightly smaller than the length of the sheets 13, 13 are put on top of the sheets 13, 13, respectively, and then fused (at 15) along three edges (both longitudinal edges and one lateral edge) thereof to the sheets 13, 13 by heating. The remaining lateral edge of each sheet is left unfused so as to form openings 16, 16. In this manner, two pockets 17, 17 are formed respectively on the two sheets 13, 13.

Long openings or windows 18, 18, the width of which is at least sufficient to receive a finger tip, are respectively formed in the center of each of the sheets 14, 14 from the fused lateral edges thereof toward the openings at the unfused lateral edges 16, 16 thereof.

When the sheets 14, 14 are made of transparent plastics, it is convenient for bearers to see what card is in the card case and similarly convenient for them to know how many calls they can make or identify a mark that indicates the direction to insert the card in the telephone fare slit. When the sheets 14, 14 are opaque, it is desirable to provide a window 19, 19 on one longitudinal side of the sheets 14, 14 in order to allow a person to quickly determine what card is in the card case.

Also, when the free ends of the sheets 14, 14, adjacent their openings, are slightly bulged at the centers thereof, the cards 1 can be put in the pockets 17, 17 with ease.

The card case of the first embodiment of this invention is constructed as described above. The manner in which the card case is usable will now be described below in detail.

A card 1 can be put in each of the pockets 17, 17 through the openings 16, 16. A card can be removed from one of the pockets by putting a finger A on top of the card appearing out of the window 18 in such a way as to slide the card toward the opening 16, as shown in FIG. 2, and then grasping between fingers and pulling on the portion of the card extending from the opening 16.

Figure 3:
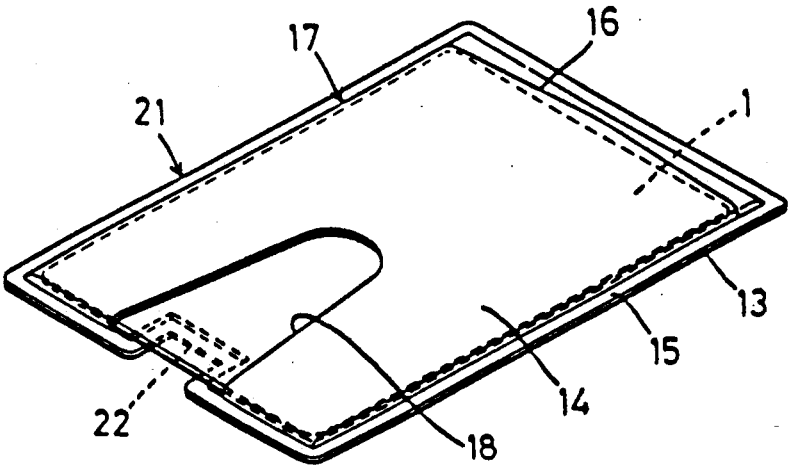
FIG. 3 is a perspective view of a card case according to a second embodiment of this invention.

FIG. 3 shows a card case 21 according to a second embodiment of this invention. In the following embodiments the same numbers and the same symbols as those in FIGS. 1 and 2 are to be allotted to identify any portion corresponding to a portion in the first embodiment.

The card case 21 of the second embodiment is produced by putting a cover sheet 14, the length and width of which are slightly greater than those of the card 1, on a base sheet 13, the length and width of which are slightly greater than those of the sheet 14. The sheet 14 is then fused along three edges thereof, i.e., both longitudinal edges and one lateral edge, to the sheet 14. The remaining lateral edge is left unfused to form an opening 16. A long opening or window 18 adapted to receive a finger tip is provided through the sheet 14 from the center of the fused lateral edge toward the opening 16.

When the window 18 is formed from the fused lateral edge of the pocket 17 as shown in the first and the second embodiments, bearers can hook their finger nail on the end of the card 1 in the pocket 17, whereby they can remove the card 1 readily. Moreover, when a hole 22 is formed through the base sheet 13 adjacent where the window 18 is formed through the cover sheet 14, as shown in FIG. 3, a portion of the card end is exposed, and allows the bearer to firmly grasp the card between his fingers and remove it.

How much the card end is to be pushed out by a finger tip A is dependent on how long the opening 18 is. In the case of a card case for telephone cards, for example, it is convenient for bearers when the length of the opening 18, i.e. the length of portion of the card end to be pushed out of the card case, is equal to the gap between the fare slit and the card feed roll of the telephone, because they can insert the card end in the telephone fare slit without removing the card from the case.

Figure 4:
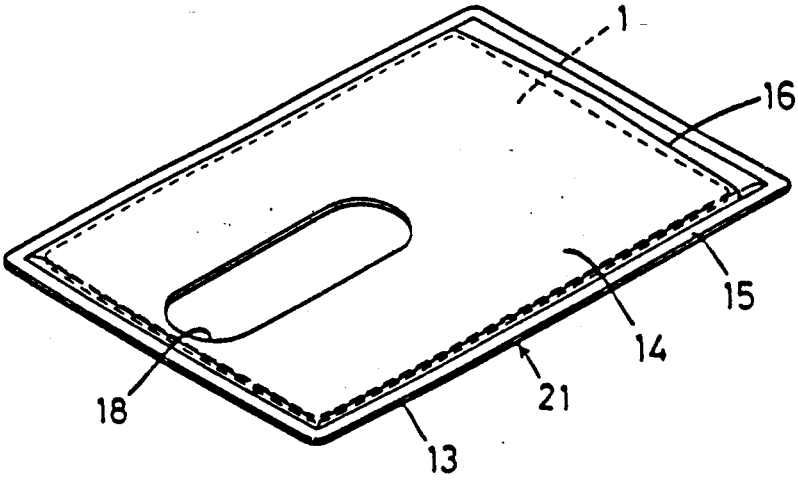
FIG. 4 is a perspective view of a card case according to a third embodiment of this invention.

As shown in FIG. 4, a card case 21 of the third embodiment of this invention has the same construction as the one of the second embodiment, except that the opening 18 is formed in a long oval shape in this example.

Figure 5:
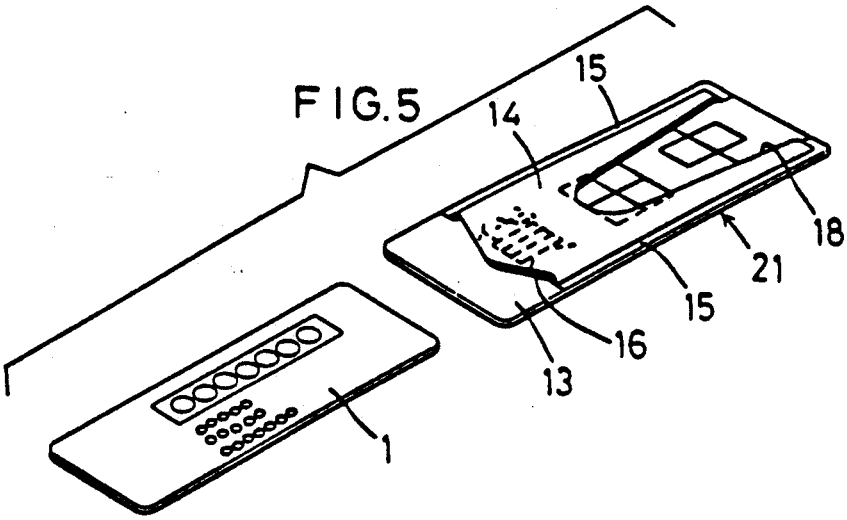
FIG. 5 is a perspective view of a card case according to a fourth embodiment of this invention.

The fourth embodiment shown in FIG. 5 is a card case 21 for holding a card that indicates particulars of video cassette tapes or video discs to be displayed in a showcase as rental. Its construction is similar to that of the second example. The card case is however to be glued on a showcase with adhesives.

Figure 6:
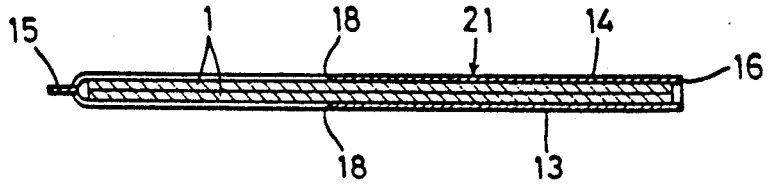
FIG. 6 is a perspective view of a card case according to a fifth embodiment of this invention.
Figure 7:
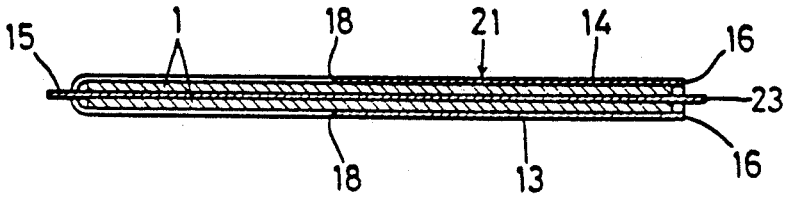
FIG. 7 is a cross-sectional view of a card case according to a sixth embodiment of this invention.

Each of the fifth embodiment shown in FIG. 6 and the sixth embodiment shown in FIG. 7 is a card case 21 for holding two cards 1, 1 at the same time. The two cards 1, 1 can be removed separately, because the card case of the fifth embodiment has an opening 18 through both of the sheets 13, 14. Thereby, each card can be removed upon request. The card case of the sixth example has a partition 23 between the sheets 13, 14, as well as the openings 18 through both sheets. In this manner, two pockets are formed independently so that bearers can remove each card selectively upon request.

Figure 8:
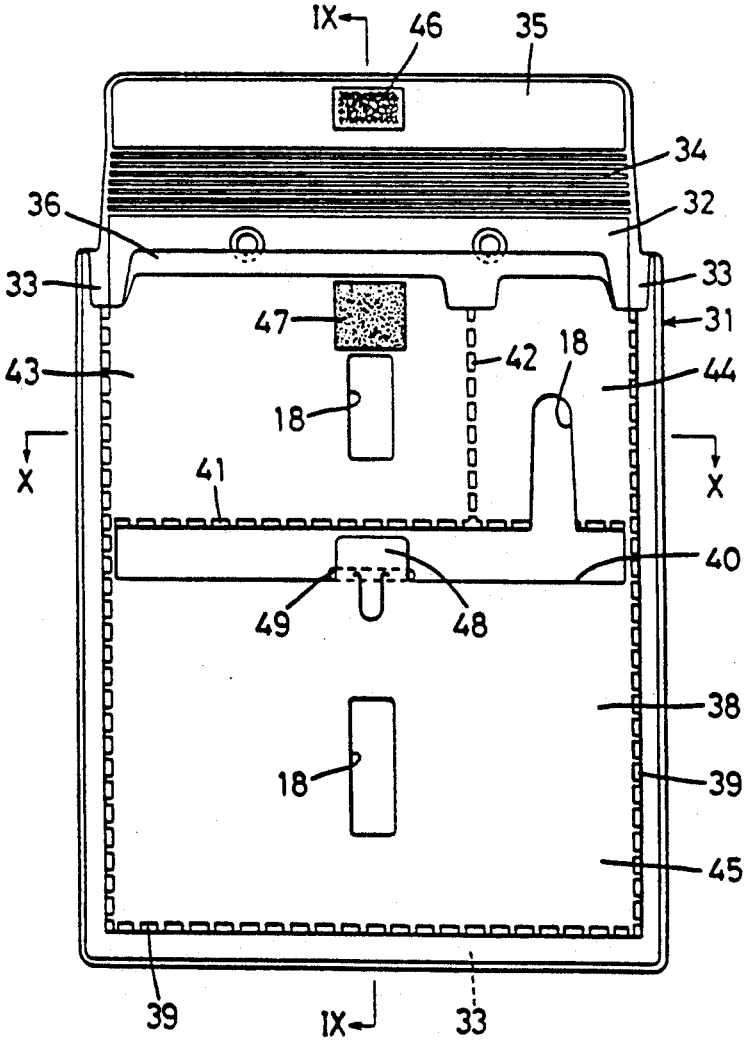
FIG. 8 is a front view of a card case according to a seventh embodiment of this invention.
Figure 9:
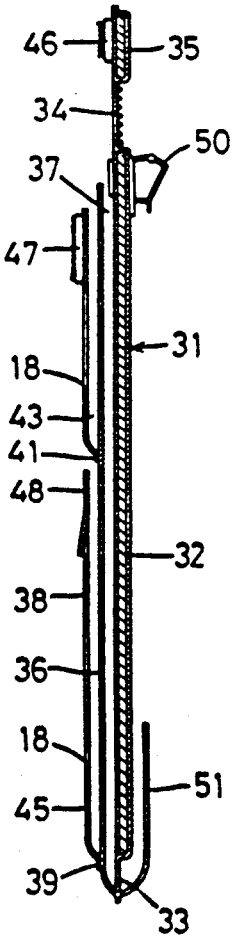
FIG. 9 is a longitudinal cross-sectional view of the card case taken along line IX—IX of FIG. 8.
Figure 10:
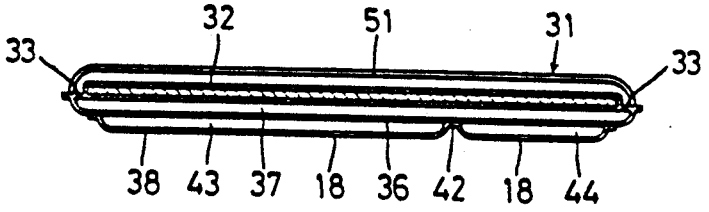
FIG. 10 is a transversal cross-sectional view of the card case taken along line X—X of FIG. 8.

The seventh embodiment shown in FIGS. 8 to 10 is a card case to be attached to the front face of a case 31 and is arranged with a view towards showing particulars of documents in the case. The case 31 includes a rectangular main (or base) hard sheet 32 and soft pliable portions that form both the longitudinal edges 31, 33 and the bottom edge 33 of the hard sheet. A lid or closure flap 35 is joined to the upper side of the main board 32 with a pliable portion 34 in between. A cover sheet 36 and the main sheet 32 are fused together at their two longitudinal edges and bottom edge with their top edge left unfused so as to form an opening and thus a pocket 37 between them. An outer sheet 38 forming a card case is put on top of the cover sheet 36 and fused thereto at its three edges 39, 39, 39 but not its top edge. An opening 40 is formed in the middle of the sheet 38 and is elongated in the transverse direction, and the portion of the sheet 38 defining the upper periphery 41 of the opening 40 is fused to the cover sheet 36. The sheet 38 is also fused centrally along a longitudinal line, to thereby form pockets 43, 44 above the opening 40. Also, one lower pocket 45 is formed below the opening 40 and cards can be put in each of the pockets.

A longitudinal opening or window 18 is provided for each of the pockets 43, 44, 45 and a pair of snaps or other attachment means 46, 47 are attached to the upper part of the sheet 38 and near the end of the closure flap 35 so that the upper pockets 43, 44 can be closed firmly by fastening one part of the attachment means on the lid 35 to the other on the sheet 38. Likewise, the pocket 45 is closed by inserting in a slit 49 a tongue 48, which projects upwardly from the portion of the sheet 38 forming the lower periphery of the opening 40. In the meantime, a clip 50 is provided to the upper part of the back of the main hard sheet 32 and a rear pocket member 51 is provided to the lower part of the back of the sheet 32 so that some paper can be put in it if necessary.

Figure 12:
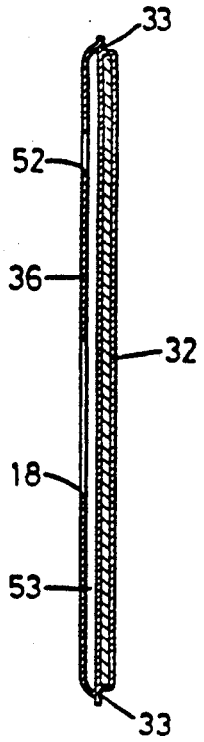
FIG. 12 is a longitudinal cross-sectional view of the card case taken along line XII—XII of FIG. 11.
Figure 11:
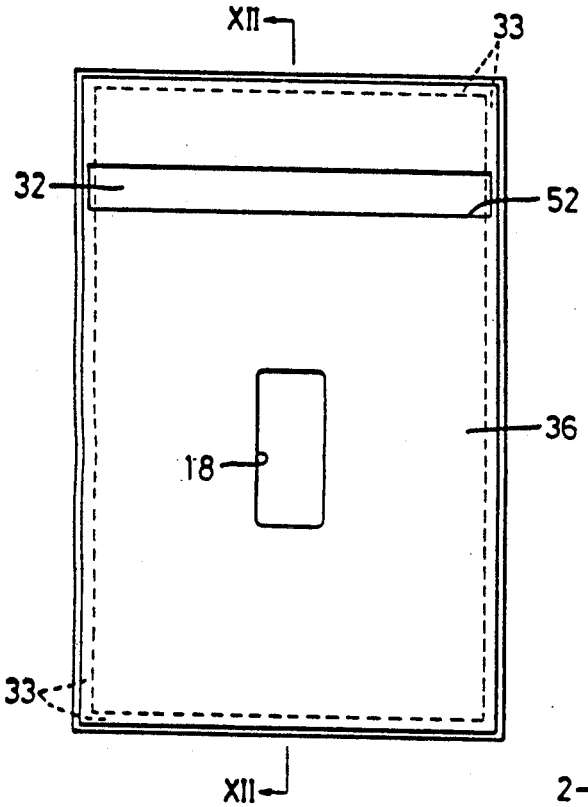
FIG. 11 is a front view of a card case of an eighth embodiment of this invention.
Figure 11:
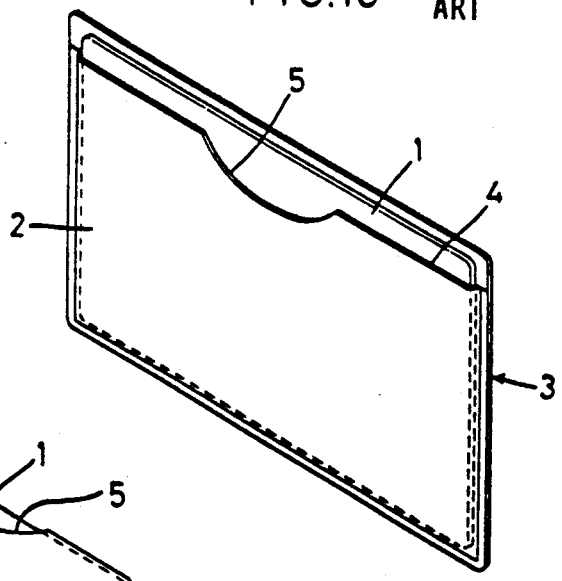
Figure 11:
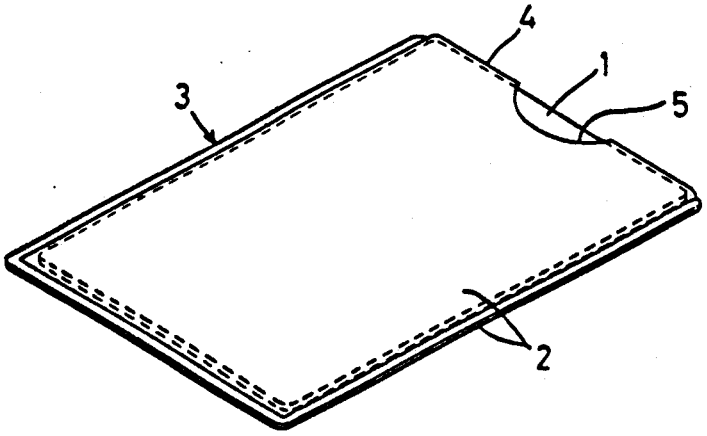

The eighth embodiment of this invention shown in FIGS. 11 and 12 is a card case constructed mainly of a rectangular main hard sheet 32 provided with surrounding pliable portions 33 and a cover sheet 36. The cover sheet 36 is fused to the surrounding pliable portions 33 of the main hard sheet 32. An opening 52, spanning the whole width of the cover sheet 36, is provided in the upper part of the cover sheet 36 and a longitudinally elongated window 18 is provided in the lower part of the cover sheet 36. A pocket 53 for holding a card is formed between the main hard board 32 and the cover sheet 36.

In any of the above mentioned embodiments, not only CD cards and telephone cards but also name cards, season tickets and the like can be put in the card case. In the case of superposed name cards, they can be removed individually in turn.

As stated above, the card case of this invention is provided with the window that is adapted to receive a finger tip. Thereby, bearers can push a card out of the pocket so as to remove it quickly even when their fingers are numbed by cold.

What is claimed is:

1. A card case comprising:

a substantially rectangular base sheet having two longitudinal edges, an upper lateral edge, and a lower lateral edge;

a substantially rectangular cover sheet having two longitudinal edges, an upper lateral edge, and a lower lateral edge, said two longitudinal edges and said lower lateral edge of said cover sheet being joined to said two longitudinal edges and said lower lateral edge, respectively, of a front face of said base sheet, and said upper lateral edge of said cover sheet remaining unjoined and separable from said upper lateral edge of said base sheet, so as to form a first pocket having an upper opening and adapted to receive a card;

a substantially rectangular outer sheet having a longitudinal direction, a lateral direction, two longitudinal edges, an upper lateral edge, and a lower lateral edge, said two longitudinal edges and said lower lateral edge of said outer sheet being joined to said two longitudinal edges and said lower lateral edge, respectively, of said cover sheet, and said upper lateral edge of said outer sheet remaining unjoined and separable from said upper lateral edge of said cover sheet, so as to form at least one additional pocket adapted to receive a card;

wherein a longitudinally elongated hole, which is elongated along the longitudinal direction of said outer sheet, is formed through a lower portion of said outer sheet and is adapted to receive a finger therethrough to push a card out of the at least one additional pocket; and wherein a laterally elongated hole, which is elongated along the lateral direction of said outer sheet, is formed through said outer sheet at a longitudinally intermediate portion thereof, and a portion of said outer sheet forming an upper peripheral edge of said laterally elongated hole is joined to said cover sheet, such that an upper pocket is formed above said laterally elongated hole and a lower pocket is formed below said laterally elongated hole.

2. A card case as recited in claim 1, wherein said longitudinally elongated hole formed through a lower portion of said outer sheet is formed below said laterally elongated hole and defines a first longitudinally elongated hole; and a second longitudinally elongated hole, which is elongated along the longitudinal direction of said outer sheet, is formed through said outer sheet at a position above said laterally elongated hole.

3. A card case as recited in claim 2, wherein said outer sheet is further joined to said over sheet along a longitudinal line intermediate said two longitudinal edges of said outer sheet and above said laterally elongated holoe, so as to divide said upper pocket into a first upper pocket and a second upper pocket.

4. A card case as recited in claim 3, wherein said second longitudinally elongated hole is formed through a potion of said outer sheet which defines said first upper pocket; and a third longitudinally elongated hole is formed through a portion of said outer sheet which defines said second upper pocket.

5. A card case as recited in claim 1, further comprising a closure flap attached to an upper end of said base sheet by a pliable portion.

6. A card case as recited in claim 5, further comprising attachment means for attaching an upper portion of said closure flap to said outer sheet so as to close at least said first pocket.

7. A card case as recited in claim 1, wherein said cover sheet is slightly smaller than said base sheet, and said outer sheet is slightly smaller than said cover sheet.

8. A card case as recited in claim 1, further comprising a clip mounted to an upper portion of a rear face of said base sheet; and a rear pocket member mounted to a lower portion of said rear face of said base sheet.

9. A card case as recited in claim 1, further comprising means for rigidifying said base sheet.

10. A card case comprising:

a substantially rectangular base sheet having two longitudinal edges, an upper lateral edge, and a lower lateral edge;

a substantially rectangular cover sheet having two longitudinal edges, an upper lateral edge, and a lower lateral edge, said two longitudinal edges and said lower lateral edge of said cover sheet being joined to said two longitudinal edges and said lower lateral edge, respectively, of a front face of said base sheet, and said upper lateral edge of said cover sheet remaining unjoined and separable from said upper lateral edge of said base sheet, so as to form a first pocket having an upper opening and adapted to receive a card;

a substantially rectangular outer sheet having a longitudinal direction, a lateral direction, two longitudinal edges, an upper lateral edge, and a lower lateral edge, said two longitudinal edges and said lower lateral edge of said outer sheet being joined to said two longitudinal edges and said lower lateral edge, respectively, of said over sheet, and said upper lateral edge of said outer sheet remaining unjoined and separable from said upper lateral edge of said over sheet, so as to form at least one additional pocket adapted to receive a card;

a clip mounted to an upper portion of a rear face of said base sheet;

a rear pocket member mounted to a lower portion of said rear face of said base sheet; and wherein a longitudinally elongated hole, which is elongated along the longitudinal direction of said outer sheet, is formed through a lower portion of said outer sheet and is adapted to receive a finger therethrough to push a card out of the at least one additional pocket.

* * * * *